US009585452B2

(12) United States Patent
Wilczak et al.

(10) Patent No.: US 9,585,452 B2
(45) Date of Patent: Mar. 7, 2017

(54) HAND LUGGAGE OF THE PULL-ALONG TYPE EQUIPPED WITH A DAMPED TELESCOPIC HAND GRIP

(75) Inventors: Richard Wilczak, Antony (FR); Christophe Degoix, Paris (FR)

(73) Assignee: Louis Vuitton Malletier, Paris (FR)

( * ) Notice: Subject to any disclaimer, the term of this patent is extended or adjusted under 35 U.S.C. 154(b) by 1358 days.

(21) Appl. No.: 12/223,501

(22) PCT Filed: Jan. 16, 2007

(86) PCT No.: PCT/FR2007/000076
§ 371 (c)(1),
(2), (4) Date: Jul. 31, 2008

(87) PCT Pub. No.: WO2007/088257
PCT Pub. Date: Aug. 9, 2007

(65) Prior Publication Data

US 2009/0026031 A1 Jan. 29, 2009

(30) Foreign Application Priority Data

Feb. 1, 2006 (FR) ..... 06 00934

(51) Int. Cl.
*A45C 13/26* (2006.01)

(52) U.S. Cl.
CPC ..... *A45C 13/262* (2013.01)

(58) Field of Classification Search
USPC ..... 190/18 A, 115; 16/113.1
See application file for complete search history.

(56) References Cited

U.S. PATENT DOCUMENTS

| | | | | | |
|---|---|---|---|---|---|
| 5,499,702 | A | | 3/1996 | Wang | |
| 5,522,615 | A | * | 6/1996 | Kazmark et al. | 280/655 |
| 5,655,260 | A | | 8/1997 | Chang | |
| 5,692,266 | A | * | 12/1997 | Tsai | 16/113.1 |
| 5,803,214 | A | * | 9/1998 | Wang | 190/115 |
| 5,884,362 | A | * | 3/1999 | Tsai | 16/113.1 |
| 6,161,253 | A | * | 12/2000 | Tu | 16/113.1 |
| 2002/0096410 | A1 | | 7/2002 | Nykoluk | |
| 2003/0038007 | A1 | * | 2/2003 | Han | 190/115 |
| 2005/0067245 | A1 | * | 3/2005 | Tsai | 190/115 |
| 2008/0078053 | A1 | * | 4/2008 | Lu | 16/113.1 |

OTHER PUBLICATIONS

International Search Report in PCT/FR2007/000076 dated Jul. 10, 2007.

* cited by examiner

*Primary Examiner* — Tri Mai
(74) *Attorney, Agent, or Firm* — McCracken & Gillen LLC

(57) ABSTRACT

Luggage of the pull-along type comprises a container, a sleeve fixed to the container, and a telescopic tube mounted in a sliding fashion in the sleeve between a retracted position, and a deployed position. The luggage further includes a resilient element interposed between the tube and the sleeve, designed to allow the tube to be pushed into the sleeve beyond the retracted position against a restoring force exerted on the tube by the resilient member.

13 Claims, 6 Drawing Sheets

HAND LUGGAGE OF THE PULL-ALONG TYPE EQUIPPED WITH A DAMPED TELESCOPIC HAND GRIP

FIELD OF THE INVENTION

The invention relates to luggage, and more precisely to luggage of the pull-along type, commonly called Trolleys®.

BACKGROUND OF THE INVENTION

Such a luggage generally comprises a container which forms the useful part of the luggage, a sleeve fixed to the container, as well as a tube generally provided with a projecting hand grip mounted in a sliding fashion in the sleeve between a retracted position in which the tube is received in the sleeve for carrying the luggage or for storage, and a deployed position in which the tube extends beyond the sleeve in order to facilitate pulling the luggage along.

Pull-along luggage provided with telescopic tubes have been known for a long time. Whilst the telescopic tube improves the ergonomics of the luggage, it still poses some practical problems.

Firstly, such a tube proves to be relatively bulky. It has been proposed to make it disappear into the container (see for example US Patent Application 2002/0096410), but it then cuts down the useful volume of the luggage.

Secondly, repeated use leads to the appearance of clearance in the mechanism of the tube which has a tendency, when handled roughly (for example in an airport environment), to come out of the sleeve at the wrong moment, which can lead to it breaking in the case of impact.

It has therefore been proposed to make the tube so that it can be locked in the retracted position and integrated, as well as its hand grip, in the volume of the container: the tube is provided with a lock with two positions, namely a locking position in which the lock blocks the tube in the retracted position, and an unlocking position in which it releases it. A spring catch, which can be actuated manually, causes the lock to be positioned in its unlocked position, thus releasing the tube which can be deployed in order to allow the luggage to be pulled along. A release device connected to springs optionally makes it possible to make the tube spring out of its housing in order to make it easy to grasp for pulling along. By way of illustration of these aims, reference can be made to the U.S. Pat. No. 5,499,702, U.S. Pat. No. 5,653,319, U.S. Pat. No. 5,692,266 and U.S. Pat. No. 5,803,214.

These mechanisms appear, at first sight, to mark progress in terms of the ability of the luggage to resist impacts. In practice, it has been noted that certain tubes have a tendency to split, or even break, under certain impacts resulting in particular from the luggage being dropped vertically. It even happens, as a consequence, that the container itself is damaged by the movement of the tube. In fact, the tube and its hand grip remain exposed to certain impacts, in particular those transmitted from the hand grip to the tube, even in the retracted position.

This is even more applicable when the luggage is semi-rigid or flexible, as the container is deformed to a greater or lesser extent under the action of mechanical stresses which expose the tube and particularly its hand grip even more, in the event of impacts.

Thus, the tube and its hand grip remain exposed to certain impacts, which are all the more likely to lead to malfunctioning of the tube or in the worst case, irreparably damage the luggage.

OBJECTS AND SUMMARY OF THE INVENTION

The invention is intended in particular to remedy this problem, by proposing a luggage of the pull-along type, which is less sensitive to impacts than known luggage.

To this end, the proposed luggage, of the abovementioned type, also comprises a resilient element, interposed between the tube and the sleeve and designed to allow the tube to be pushed into the sleeve beyond the retracted position against a restoring force exerted on the tube by the resilient element.

Thus, the tube retains a certain movement in the retracted position which allows it to be pushed in under the effect of an impact, in particular a vertical impact, with a damping effect of the impact provided by the resilient element. This results in better impact-resistance of the tube (and therefore, more generally, of the luggage).

In the retracted position of the tube, the resilient element is preferably prestressed.

According to an embodiment, the resilient element comprises at least one compression spring, and preferably a pair of compression springs. The resilient element is for example mounted in a support fixed to the sleeve.

According to an embodiment, the resilient element has a lower portion received in a housing arranged in the support, and an upper portion extending beyond the support and against which the tube is supported, this upper portion defining a clearance between the tube and the support. According to a first variant of this embodiment, it may suffice for the tube to be simply supported on this upper portion. According to a second variant of this embodiment, the tube, in the retracted position, compresses the resilient element.

Moreover, the tube can comprise locking means which ensure retention of the tube in the retracted or deployed position. These locking means comprise for example a ball, mounted in the tube, acted upon by a spring and capable of cooperating with a hole arranged in the sleeve.

More precisely, the tube can comprise an outer tube mounted in a sliding fashion in the sleeve, as well as an inner tube mounted in a sliding fashion in the outer tube, the outer tube comprising a ball acted upon by a spring and capable of cooperating with a hole arranged in the sleeve, the inner tube itself comprising a ball acted upon by a spring and suitable for cooperating with a hole arranged in the outer tube.

The container can be made of a flexible or semi-rigid material.

Other subjects and advantages of the invention will become apparent in light of the following description, made with reference to the attached drawings, in which:

DETAILED DESCRIPTION

Figure 1:
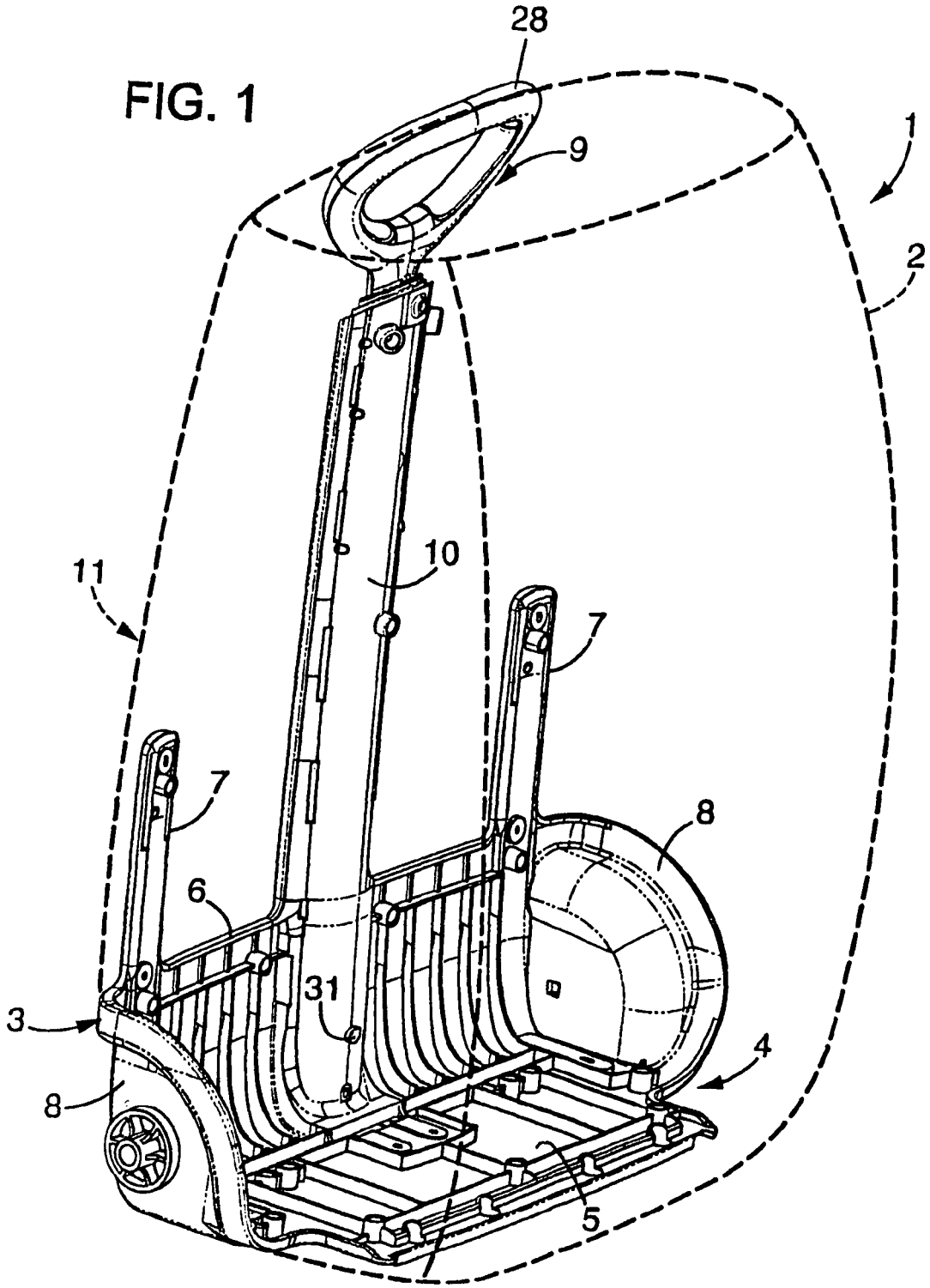
FIG. 1 is a perspective view showing a luggage equipped with a telescopic tube, in the retracted position.

FIG. 1 shows a luggage 1 of the pull-along type, commonly called a Trolley®. This luggage 1 comprises a container 2 (represented by dotted lines) made of flexible, semi-rigid or rigid material, which constitutes the body of the luggage 1, mounted and fixed onto a frame 3 in the form of a sack barrow.

The frame 3 comprises a single-piece bottom plate 4 having a base 5 on which the container 2 rests, which is extended by a rear edge 6 from the extension of which project two reinforcements 7, to which the container 2 is fixed. The base 5 and the edge 6 are connected, on each side, by two sidepieces 8 which form wheel housings (not shown).

Figure 5:
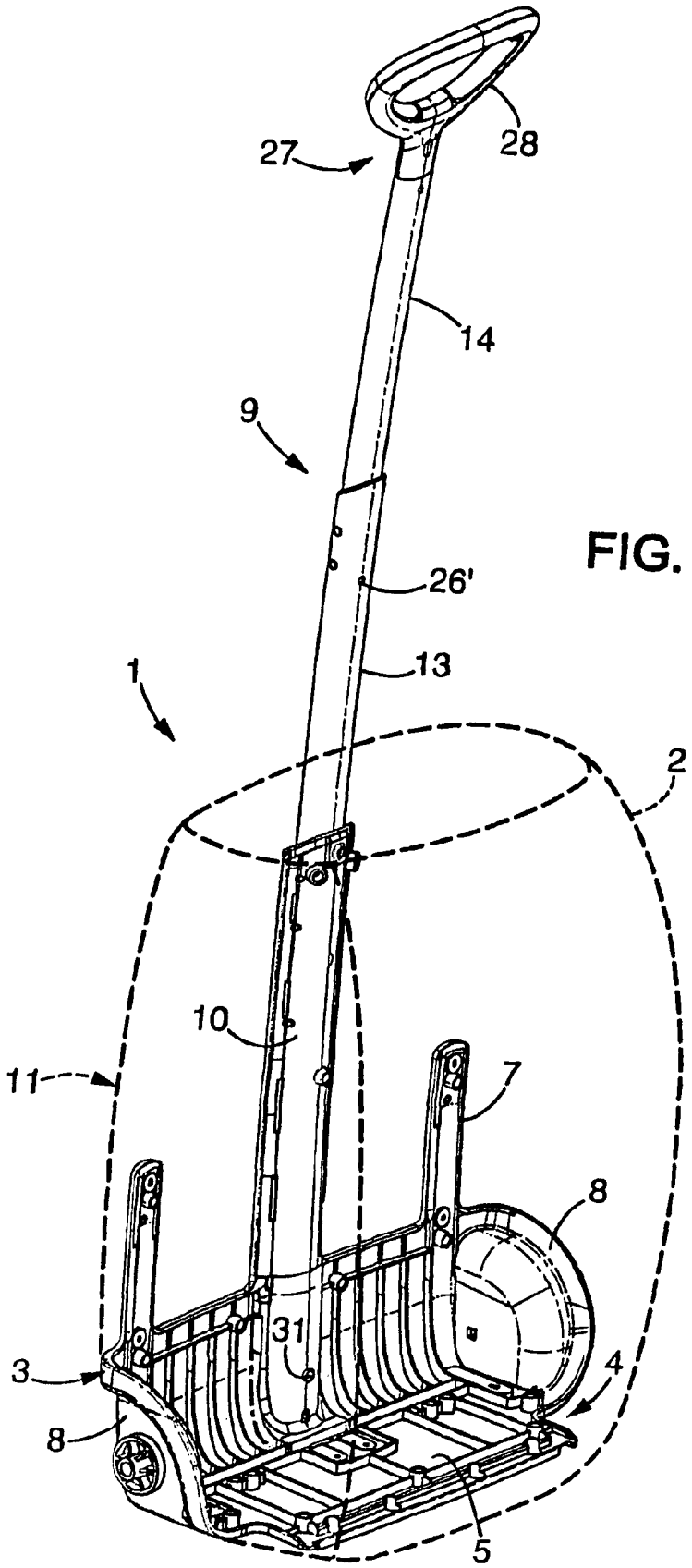
FIG. 5 is a view similar to FIG. 1, showing the luggage with its tube in the deployed position.

As can be seen in particular in FIGS. 1 and 5, the luggage 1 is moreover equipped with a telescopic tube 9 provided with a projecting hand grip and mounted in a sliding fashion with respect to the frame 3. The telescopic tube 9 can be made of a single piece or of several pieces sliding one inside the other, as shown in the drawings.

More precisely, the frame 3 comprises a sleeve 10 which extends projecting from the rear edge 6, substantially perpendicular to the base 5. This sleeve 10, which extends over the major part of the height of the container 2, is fixed to the latter while being received in a recess (not shown) made in a rear wall 11 of the container 2.

Figure 6:
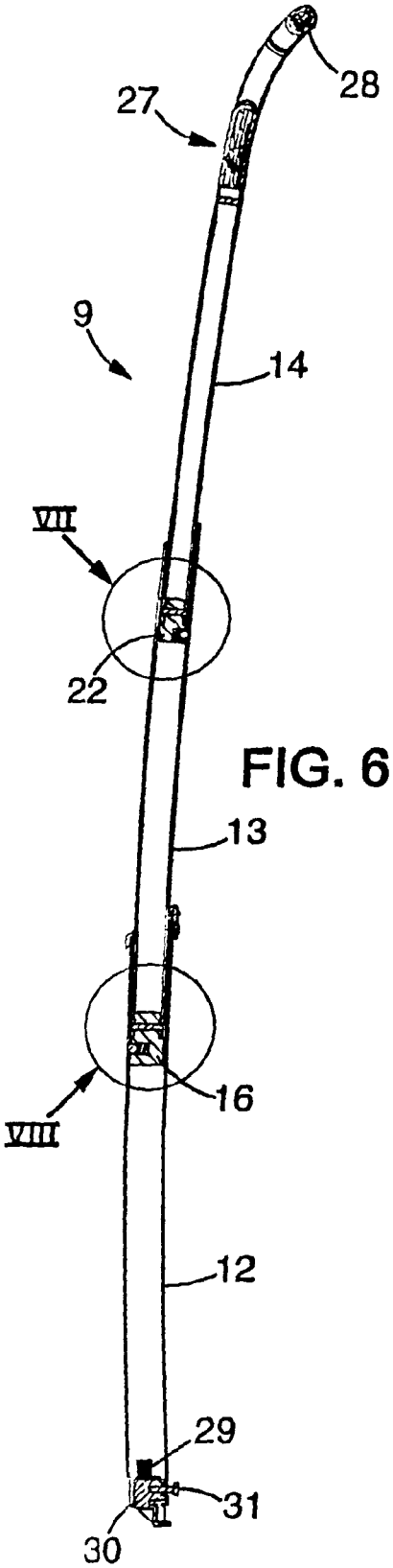
FIG. 6 is a cross-sectional elevation showing the tube in the deployed position.

The sleeve 10 comprises a metal, tubular inner sheath 12, in which the tube 9 is mounted in a sliding fashion between two positions, namely:

- a retracted position, in which the tube 9 is received in the sleeve 10 (FIGS. 2, 3), and
- a deployed position in which the tube 9 extends at least partially outside the sleeve 10 projecting with respect to the latter (FIGS. 5, 6).

Figure 2:
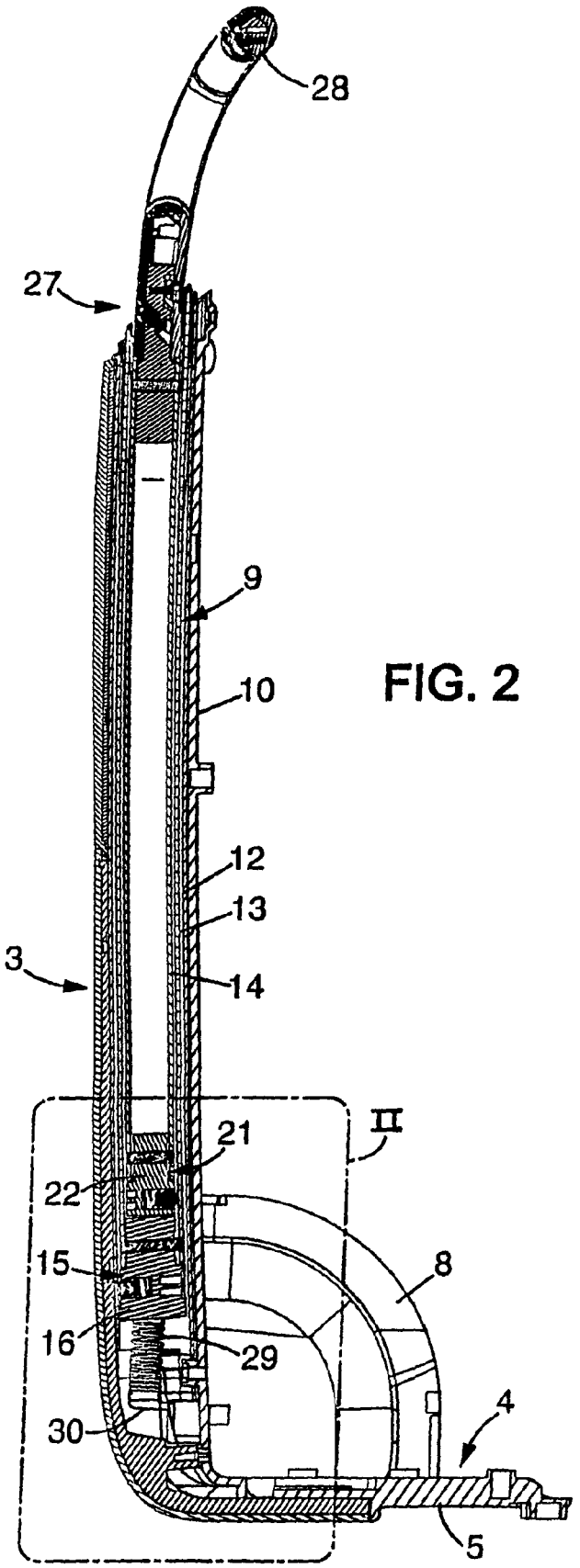
FIG. 2 is a partial cross-sectional view showing a longitudinal elevation of the luggage of FIG. 1.

As can be seen in FIGS. 1, 2 and 5, the tube 9 comprises a hollow outer tube 13, received in the sheath 12 while being mounted in a sliding fashion with respect to the latter, and an inner tube 14, also hollow, received in the outer tube 13 while being mounted in a sliding fashion with respect to the latter.

Figure 8:
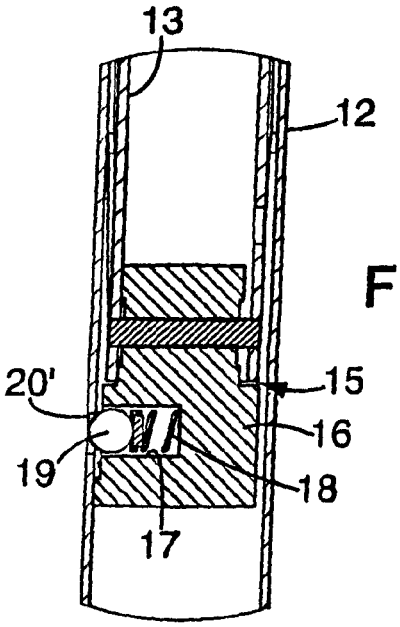
FIG. 8 shows detail VIII of FIG. 6 on an enlarged scale.

At a lower end 15, the outer tube 13 is integral with a nested insert 16, provided with a blind bore 17 in which a compression spring 18 is received, which acts on a ball 19 in the direction of the sheath 12. In the retracted and deployed positions of the tube 9, the ball 19 is partially received in a hole 20 (20' respectively) with a diameter less than that of the ball 19, made in the sheath 12 in order to ensure the retention of the outer tube 13 (in the retracted position, cf. FIG. 3, in the deployed position, cf. FIG. 8, respectively).

Figure 7:
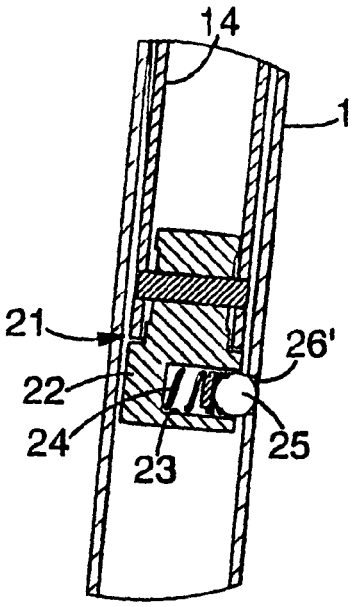
FIG. 7 shows detail VII of FIG. 6 on an enlarged scale.

Similarly, at a lower end 21, the inner tube 14 comprises a nested insert 22, provided with a blind bore 23 in which a compression spring 24 is received which acts on a ball 25 in the direction of the outer tube 13. In the retracted and deployed positions of the tube 9, the ball 25 is partially received in a hole 26 (26' respectively) with a diameter less than that of the ball 25, made in the outer tube 13 in order to ensure the retention of the inner tube 14 (in the retracted position, cf. FIG. 3, in the deployed position, cf. FIG. 7, respectively).

Figure 3:
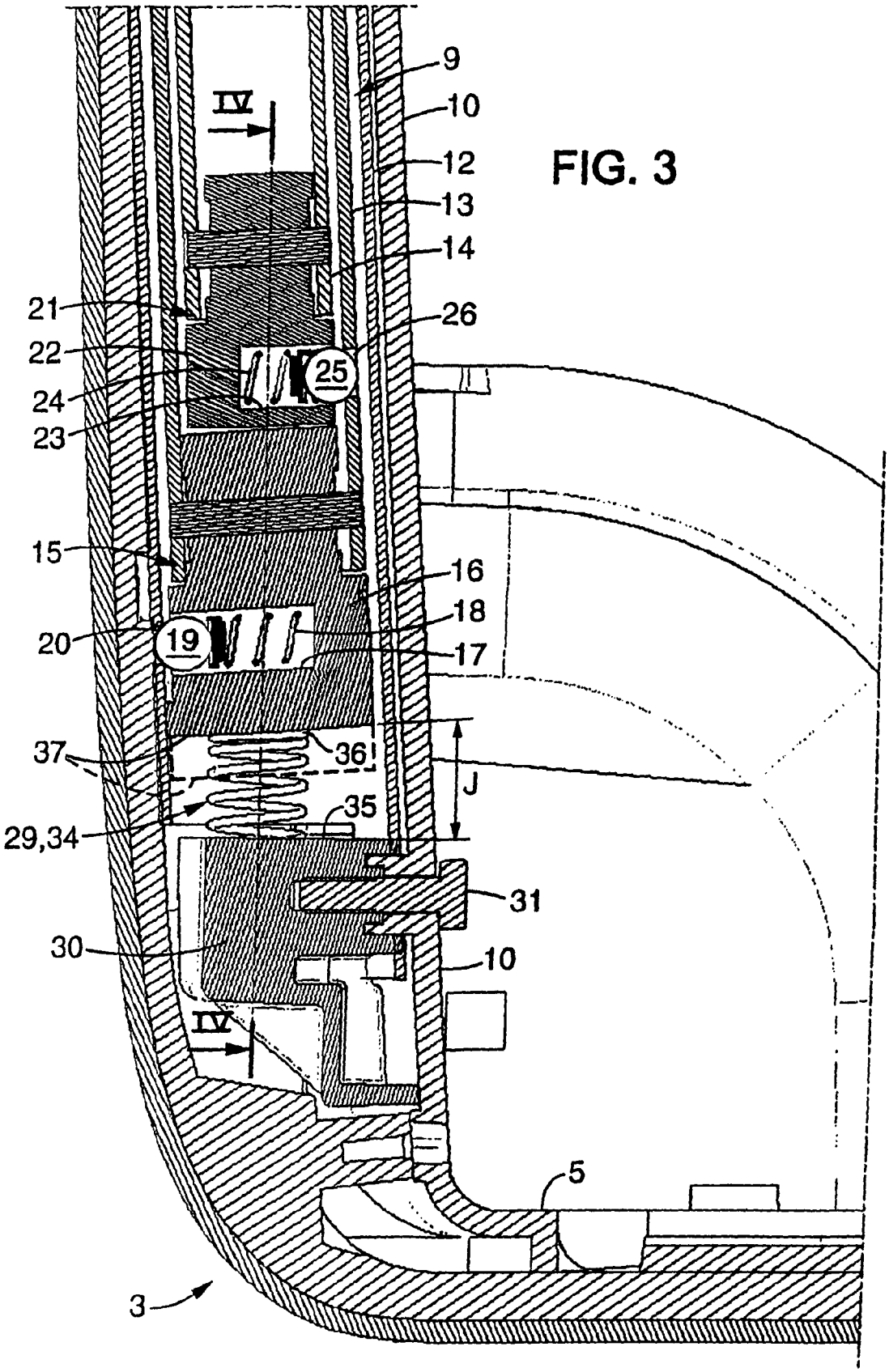
FIG. 3 shows detail II of FIG. 2 on an enlarged scale.

As can be seen clearly in FIG. 3, the bores 17, 23 are orientated opposite one another, so as to allow a relative balance of the internal forces exerted on the tube 9.

The tube 9 terminates, at an upper end 27, in a ring-shaped hand grip 28 nested in the inner tube 14 and permanently fixed to the latter.

Figure 4:
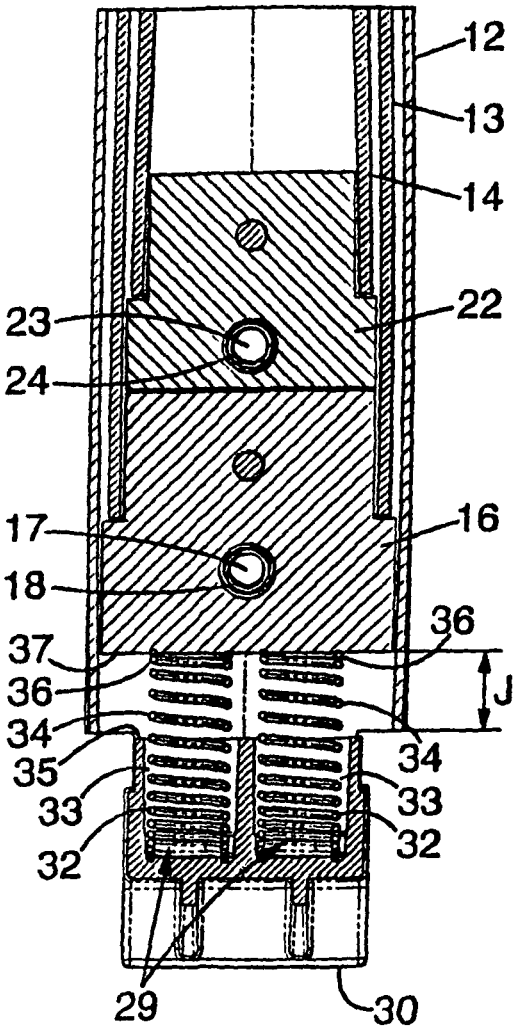
FIG. 4 is a crow-sectional view along the line IV-IV of FIG. 3.

Moreover, as can be seen in particular in FIGS. 2, 3 and 4, the luggage 1 also comprises a resilient element 29, interposed between the tube 9 and the sleeve 10, and which, in the retracted position of the tube 9, exerts a restoring force on the latter which pulls it towards its deployed position.

According to an embodiment, and as represented in FIGS. 3 and 4, the resilient element 29 comprises at least one compression spring. In this case, two parallel compression springs 29 are provided, mounted in a separate shared support 30, permanently fixed (for example by means of a screw 31) to the sleeve 10, at the bottom of the latter.

In the retracted position of the tube 9, the balls 19, 25 are locked into their respective holes 20, 26. The tube 9 exerts a force on the springs 29 which tends to compress them beyond their balance position, the restoring force of the thus prestressed springs 29 being insufficient to displace the balls 19, 25 from their respective holes.

Each spring 29 has a lower portion 32 received in a complementary cylindrical housing 33 which ensures both the stop (or the catching) and the guiding of the spring 29. As can be seen in FIGS. 3 and 4, each spring 29 has an upper portion 34 which passes beyond an upper surface 35 of the support 30 (on the side of which the housings 33 open) and terminates in an upper end 36 against which the tube 9, via a lower surface 37 of the insert 16, is simply supported.

In this manner, the springs 29 define, in the retracted position of the tube 9, a clearance J between the latter and the support 30 (more precisely between the lower surface 37 of the insert 16 and the upper surface 35 of the support 30), this clearance allowing the tube 9 to be pushed into the sleeve 10 beyond its retracted position (as represented by dotted lines in FIG. 3), against the restoring force of the springs 29.

In this manner, the tube 9, in its retracted position, is subjected, via the hand grip 28, to a force (for example following an impact) directed in particular parallel to its sliding direction and in the direction of its retraction, the clearance J provided by the springs 29 allow it to be pushed in an elastic manner. The tube 9 then returns to its retracted position by means of the springs 29, as soon as this force disappears.

As a result the springs 29 have a function of damping the impacts to which the tube 9 is subjected, which minimizes both the risks of damage to (or even the breaking of) the latter and the consequential effect of the impacts on the luggage 1 as a whole (to the benefit of the integrity of the goods that it is transporting).

The invention claimed is:

1. Luggage of the pull-along type, which comprises:

a container;

a sleeve fixed to the container;

a telescopic tube mounted in a sliding fashion in the sleeve between a retracted position and a deployed position, the telescopic tube being provided with a locking member which ensures retention of the tube in the retracted position, the locking member comprises a ball, mounted in the tube, acted upon by a spring and capable of cooperating with a hole arranged in the sleeve, wherein in the retracted position of the tube, the ball is partially received in the hole; and a resilient element, interposed between the tube and the sleeve, mounted in a support at the bottom of the sleeve;

wherein there is a clearance between the tube and the support when the telescopic tube is in the retracted position, wherein the resilient element is located in the clearance; and wherein under the effect of an impact directed toward the direction of the retraction of the tube in the retracted position, the ball partially received in the hole and the resilient element enable the tube to be pushed in an elastic manner into the sleeve beyond the retracted position against a restoring force exerted on the tube by the resilient element, the tube returning in the retracted position by means of the resilient element as soon as this impact disappears.

2. Luggage according to claim 1, in which said resilient element comprises at least one compression spring.

3. Luggage according to claim 2, in which said resilient element comprises a pair of compression springs.

4. Luggage according to claim 3, in which the resilient element is mounted in a support fixed to the sleeve.

5. Luggage according to claim 3, in which the container is made of a flexible or semi-rigid material.

6. Luggage according to claim 2, in which the resilient element is mounted in a support fixed to the sleeve.

7. Luggage according to claim 6, in which the resilient element has a lower portion received in a housing arranged in the support, and an upper portion, protruding from the support and against which the tube is supported, this upper portion defining a clearance between the tube and the support.

8. Luggage according to claim 7, in which the tube, in the retracted position, compresses the resilient element.

9. Luggage according to claim 8, in which the container is made of a flexible or semi-rigid material.

10. Luggage according to claim 7, in which the tube is simply supported against the spring.

11. Luggage according to claim 10, in which the container is made of a flexible or semi-rigid material.

12. Luggage according to claim 1, in which the tube comprises locking means which ensure the retention of the tube in the retracted or deployed position.

13. Luggage according to claim 1, in which the container is made of a flexible or semi-rigid material.

* * * * *